United States Patent [19]

Brännström

[11] Patent Number: 4,699,210

[45] Date of Patent: Oct. 13, 1987

[54] APPARATUS FOR CONVEYING PARTICULATE MATERIAL FROM A PRESSURIZED CONTAINER

[76] Inventor: Roine Brännström, Pir vägen38, S-612 00 Finspong, Sweden

[21] Appl. No.: 563,427

[22] Filed: Dec. 20, 1983

Related U.S. Application Data

[63] Continuation-in-part of Ser. No. 445,635, Nov. 30, 1982, abandoned.

[30] Foreign Application Priority Data

| | | | |
|---|---|---|---|
| Oct. 8, 1982 | [SE] | Sweden | 8205748 |
| Feb. 24, 1983 | [SE] | Sweden | 8301024 |
| Jun. 9, 1983 | [SE] | Sweden | 8303272 |
| Jul. 14, 1983 | [SE] | Sweden | 8303977 |

[51] Int. Cl.[4] ..... F24H 3/02

[52] U.S. Cl. ..... 165/120; 406/193; 34/57 R

[58] Field of Search ..... 165/120; 34/57 R, 62, 34/67; 406/193

[56] References Cited

U.S. PATENT DOCUMENTS

| | | | |
|---|---|---|---|
| 610,066 | 8/1898 | Kuser | 165/120 |
| 2,056,022 | 9/1936 | Steenstrup | 165/120 |
| 2,311,868 | 2/1943 | Rhoads | 165/120 |
| 2,434,435 | 1/1948 | Reibel | 165/120 |
| 2,622,937 | 12/1952 | Taylor | 406/193 |
| 2,718,754 | 9/1955 | Lewis et al. | 165/120 |
| 3,204,942 | 9/1965 | Matthys et al. | 165/120 |
| 3,313,035 | 4/1967 | Crawford et al. | 34/57 R X |
| 3,974,572 | 8/1976 | Cerles et al. | 165/120 |
| 4,106,210 | 8/1978 | Jukkola | 34/57 R X |
| 4,387,914 | 6/1983 | Paulson et al. | 406/193 X |

FOREIGN PATENT DOCUMENTS

| | | | |
|---|---|---|---|
| 687239 | 5/1964 | Canada | 406/193 |
| 1405079 | 9/1979 | Denmark | 165/120 |
| 1082783 | 10/1958 | Fed. Rep. of Germany | 165/120 |
| 592007 | 11/1975 | Switzerland | 165/120 |
| 8205748-0 | 6/1984 | Switzerland | 165/120 |
| 1484425 | 9/1977 | United Kingdom | 165/120 |
| 2080138A | 2/1982 | United Kingdom | 165/120 |
| 650909 | 3/1979 | U.S.S.R. | 165/120 |

*Primary Examiner*—Albert W. Davis, Jr.
*Assistant Examiner*—Peggy Neils
*Attorney, Agent, or Firm*—Pollock, Vande Sande & Priddy

[57] ABSTRACT

Apparatus for conveying particulate material from a pressurized container (1) to a collecting container (20) under considerably lower pressure, comprises conduit means (17) arranged between the containers (1 and 20) and typically built up of a number of tube parts in such a way that, at the transition between the tube parts, a gas/particulate material stream flowing therethrough is bent through an angle, usually either 90° or 180°.

17 Claims, 23 Drawing Figures

Figure 1:
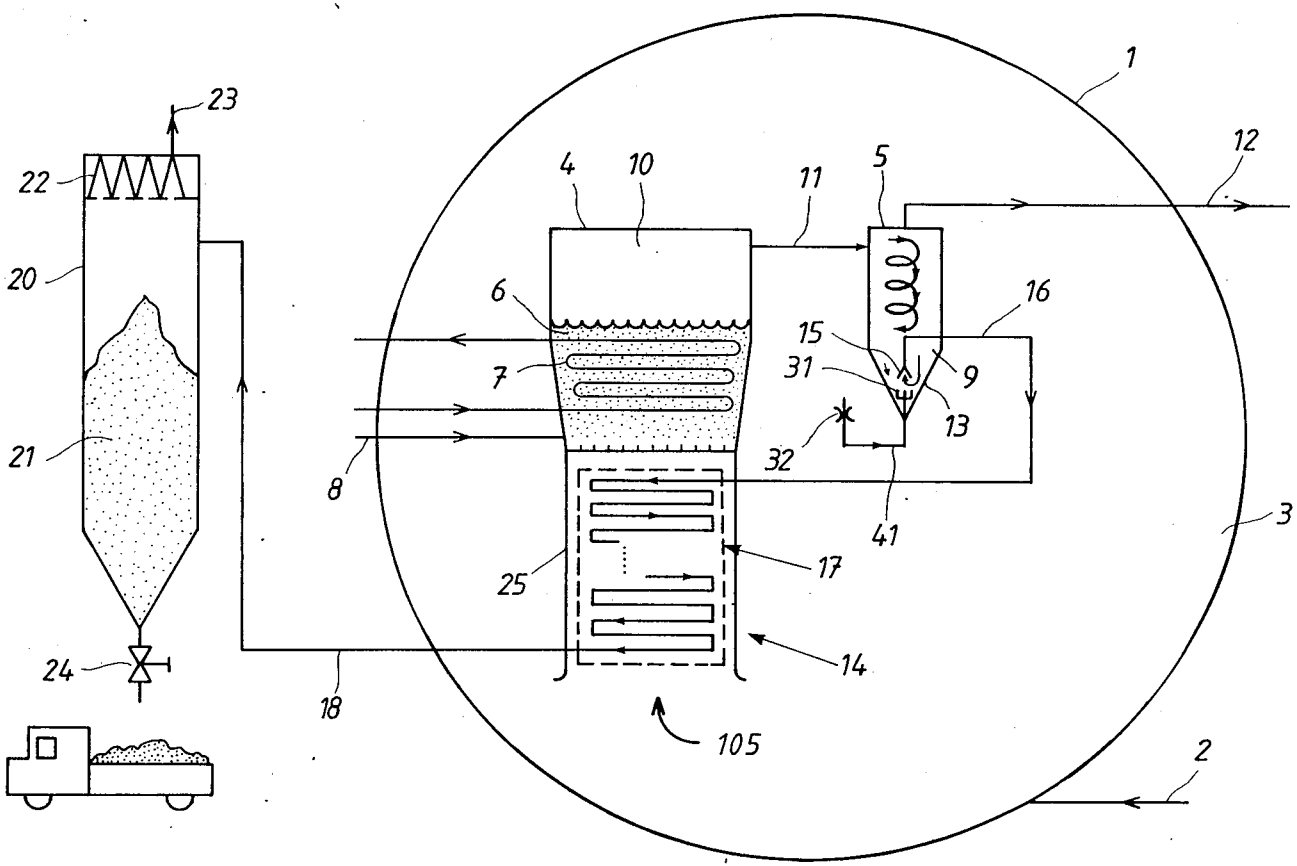

FIG. 18
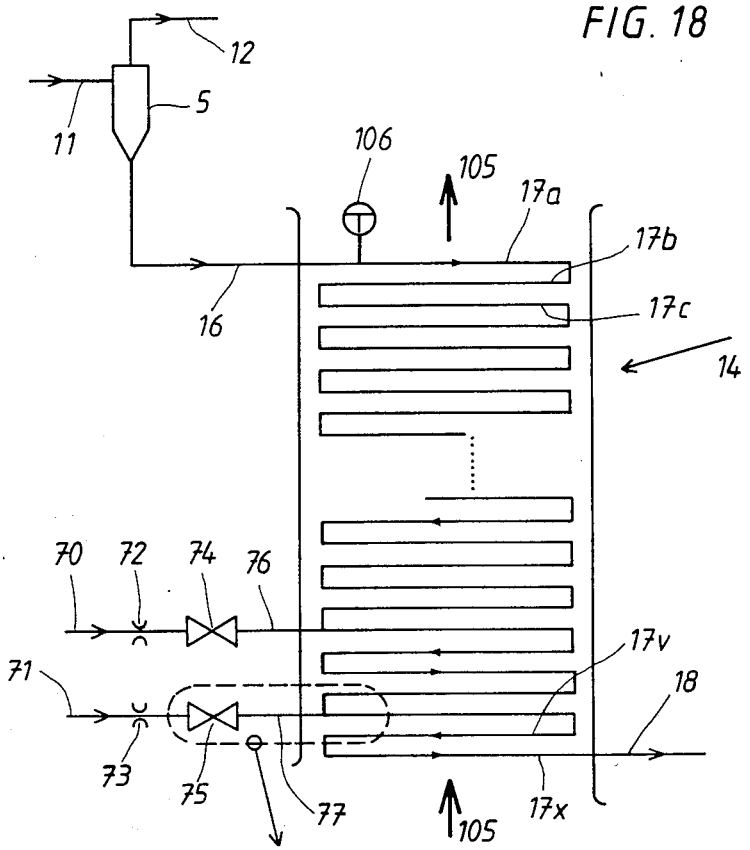
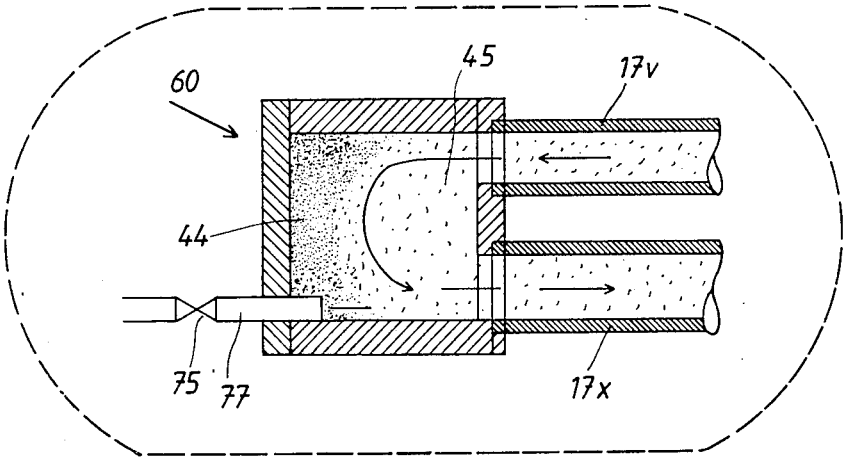
FIG. 18a

APPARATUS FOR CONVEYING PARTICULATE MATERIAL FROM A PRESSURIZED CONTAINER

This is a continuation-in-part of application Ser. No. 445,635, filed Nov. 30,1982 now abandoned.

This invention relates to apparatus for conveying particulate material, e.g. in powdered or granular form, from a pressurised container and in particular, but not exclusively, relates to apparatus for conveying or feeding out expended particulate bed material and fly ash in the form of sulphated sorbent and ash from fuel, during combustion in a pressurised fluidised bed combustion plant (PFBC plant), the particulate material being contained in pressurised containers typically under a pressure of from 6 to 20 bar.

In known PFBC plants, particulate material is fed to the combustion chamber. The larger particles of this fed-in material remain in the fluidised bed and subsequently have to be removed therefrom whereas the remainder of the fed-in material is carried away from the combustion chamber with the flue gases. This latter material, comprising the smaller particles of the fed-in material, is separated in dust separators (normally of cyclone type) from the flue gases before being passed into an ash discharge system. Conventional dust separation systems of wet or dry types may be used. However, both these types of system are normally very complicated and have many weaknesses.

For example, in a typical dry ash separation and feeding-out system for a commercial PFBC plant of 350 MW, there may be from 40 to 60 cyclones. The particulate material, after separation in the cyclones, is first transported via so-called lock hoppers to an external ash conveyor system, and with that system it is further transported, at a low pressure e.g. from 2 to 3 bar, to a storage silo. However, such a known dry type lock hopper system has the following disadvantages:

it uses many valves and other components which substantially increase the risk of faults occurring in the system, thereby reducing the availability of the plant, it places a great demand on the valves and other mechanical components such as screw feeders, rotary feeders, etc, which have to be sealed to gas as well as to solid materials at a pressure of from 6 to 20 bar, and it requires complicated measuring and control systems.

Another disadvantage of known dust separation systems with pneumatic transport to lock hoppers is that the dust carrying gas requires to be passed through a cleaning filter before leaving the pressurised ash receiver. However, there is a risk of the filters becoming clogged upon start-up and at low load when the gas temperature may be below the dew point so that sulphuric acid may be precipitated.

The prior art is disclosed in detail in an ANL-/CEN/FE-81-3 report prepared by Argonne National Laboratory, Argonne, Ill. for the U.S. Department of Energy.

The present invention aims at providing apparatus for conveying particulate material, e.g. in powdered or granular form, from a pressurised container to another container or place at lower pressure, said apparatus comprising no or few movable parts and being reliable, inexpensive to manufacture and easily maintained.

According to the invention, apparatus for conveying particulate material, e.g. in a PFBC plant, via a transport conduit means from a pressurised container to a collecting container or other place which is under lower pressure than the pressurised container, is characterised in that said transport conduit means is constructed in such a way that the direction of flow of a gas/particulate material mixture is changed repeatedly, whereby successive reductions in pressure are obtained by bend losses when the successive changes in direction occur.

At each bend the particulate material is stopped and after the bend it is accelerated again to a speed close to the speed of the transport gas. This acceleration consumes energy resulting in a pressure drop. The greater the amount of particulate material being accelerated, the greater becomes the pressure drop.

The conduit means is suitably made so that the greatest possible pressure drop occurs upon each change of direction. The conduit means may, for example, comprise a number of tube parts, arranged one after the other, which make an angle of 90° with each other, whereby the bend at each tube connection is 90°. In another embodiment, the conduit means may comprise a number of parallel densely positioned tubes with overflow openings at or near the ends of the tubes so that a diversion of 180 ° is obtained for passage from one tube to another. In order to reduce the wear, a blind space may be provided at the ends of the tubes beyond the point of diversion, where a "cushion" of particulate material is collected. This cushion receives and reduces the speed of the particulate material in the gas stream, thus preventing contact with the tube walls.

The apparatus according to the invention can also be advantageously employed as an ash cooler. Typically the temperature of the ash leaving the pressurised container may be from 800° C. to 850° C., and cooling means may be provided to cool the ash to a temperature of from 150° C. to 250° C., i.e. to a temperature which lies at a suitable level above the dew point so as to avoid the precipitation of sulphuric acid. Combustion air or steam or water can for example be used as cooling medium. Upon start-up of the apparatus, the cooling means can be operated as a heater so that condensation and clogging in the pneumatic transport line and in the feeding-out device are prevented if the gas temperature should lie at or below the dew point.

Figure 2:
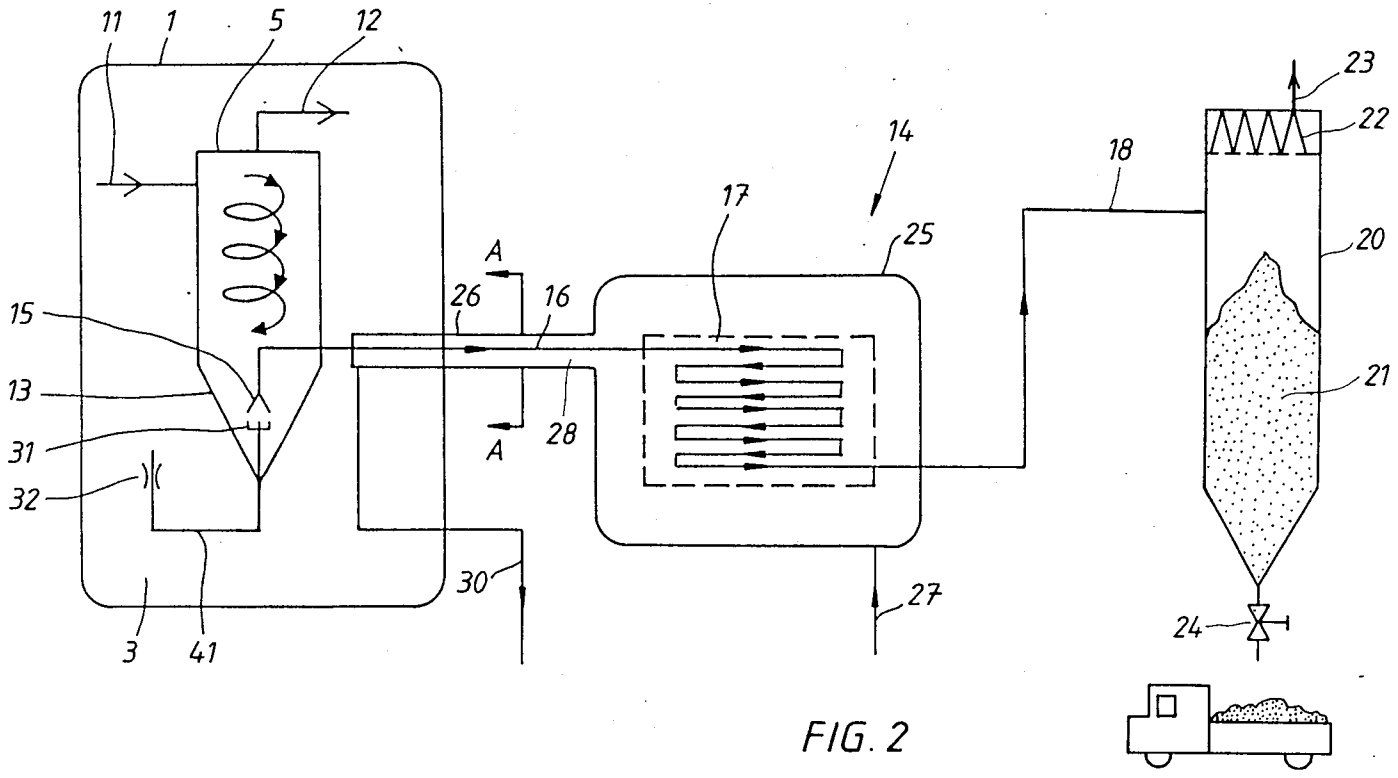
Figure 3:
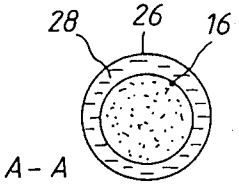
Figure 4:
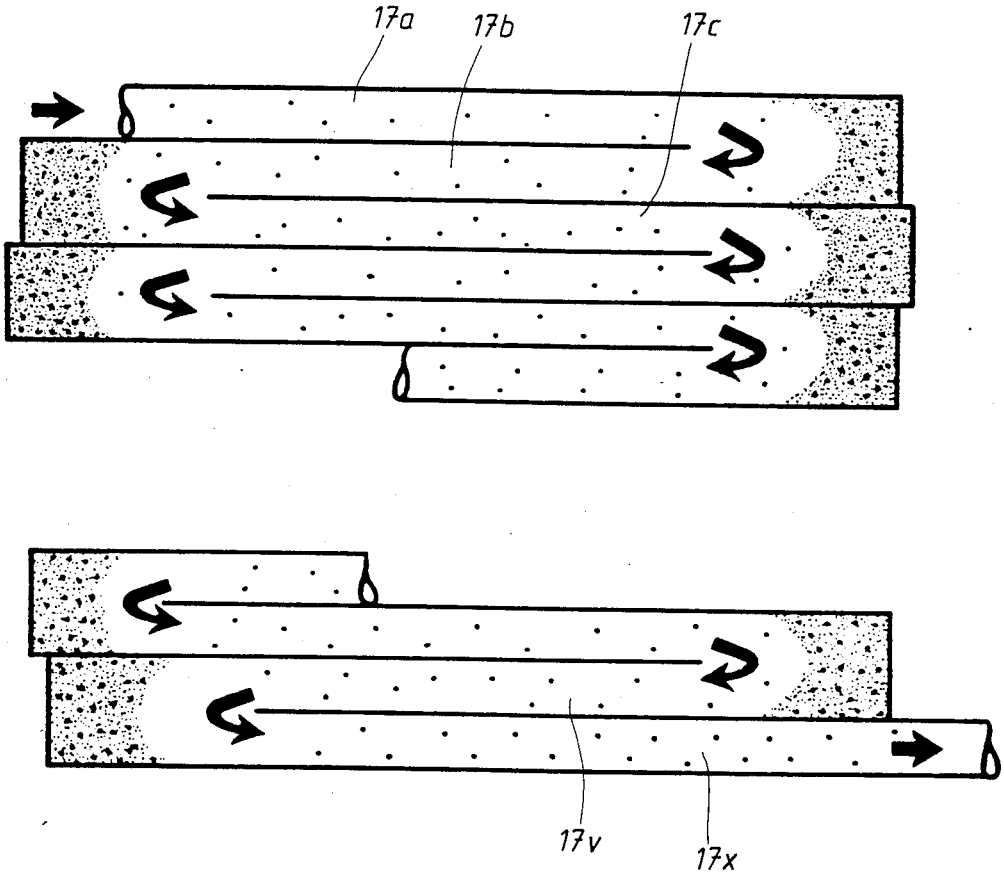
Figure 5:
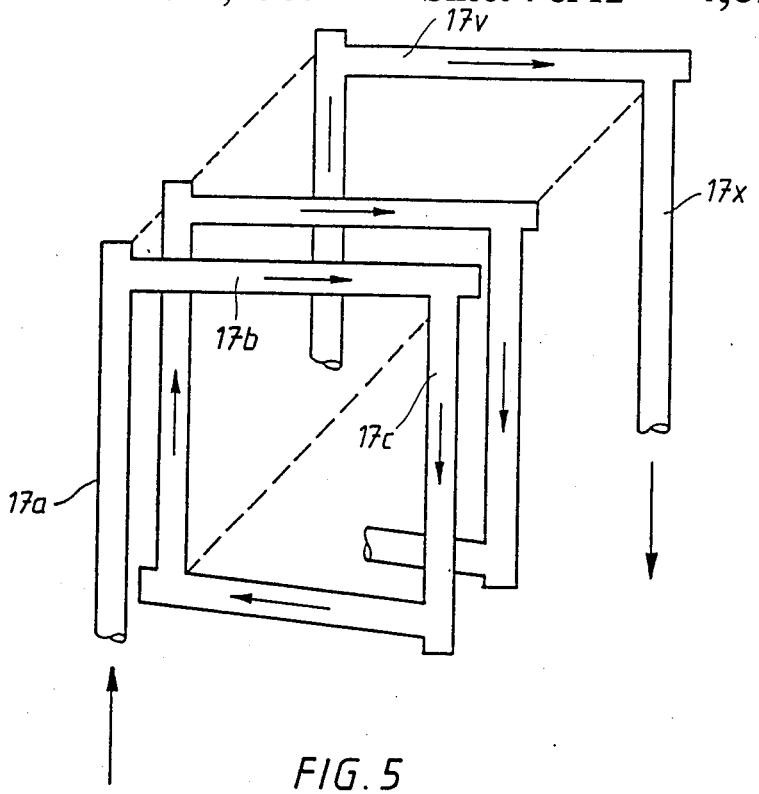
Figure 6:
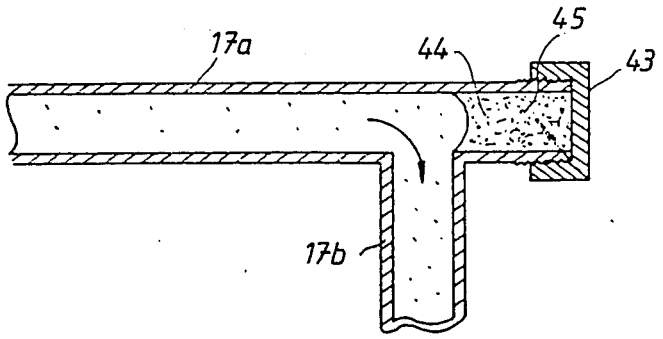
Figure 7:
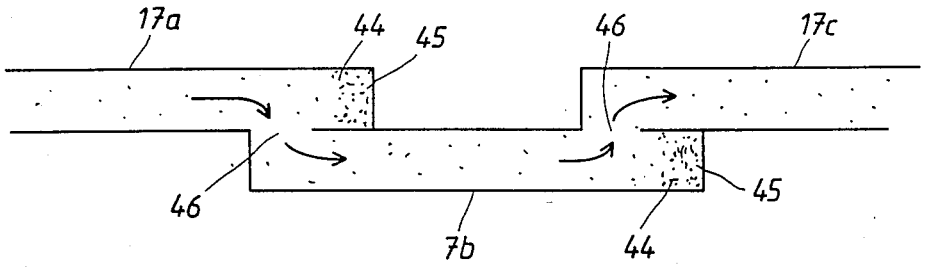
Figure 8:
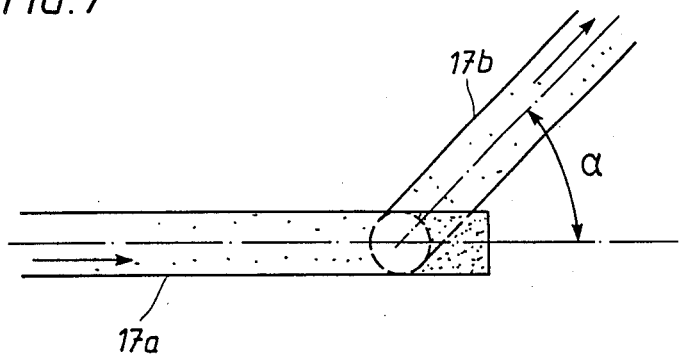
Figure 10:
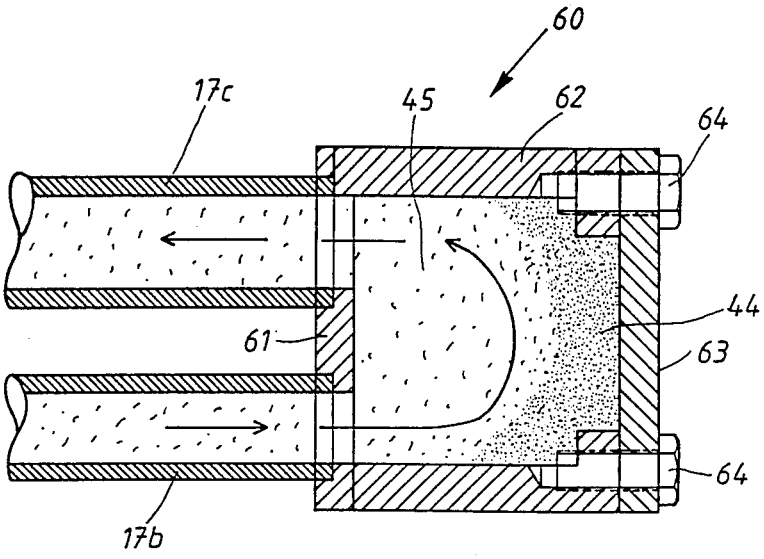
Figure 9:
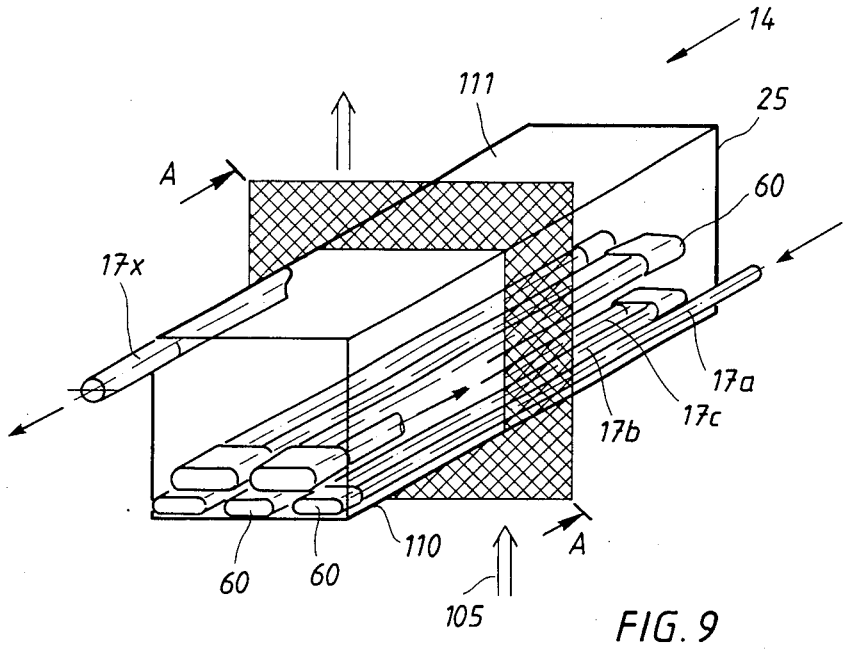
Figure 9A:
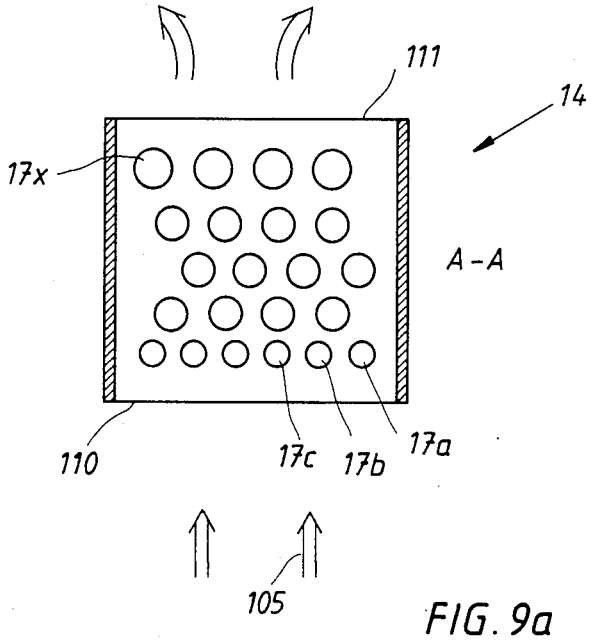
Figure 11:
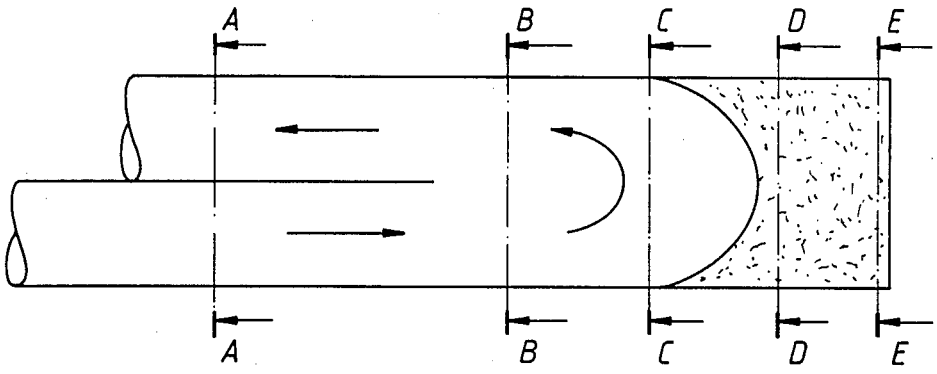
Figure 12:
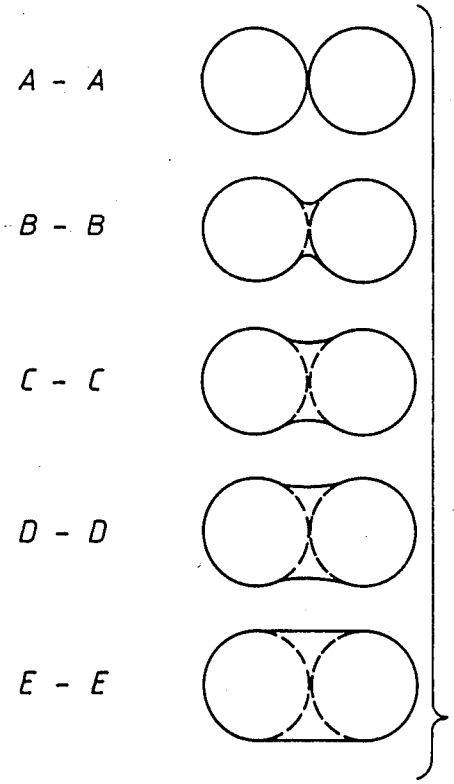
Figure 13A:
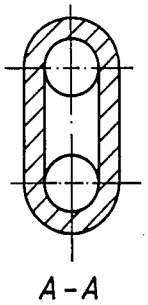
Figure 13:
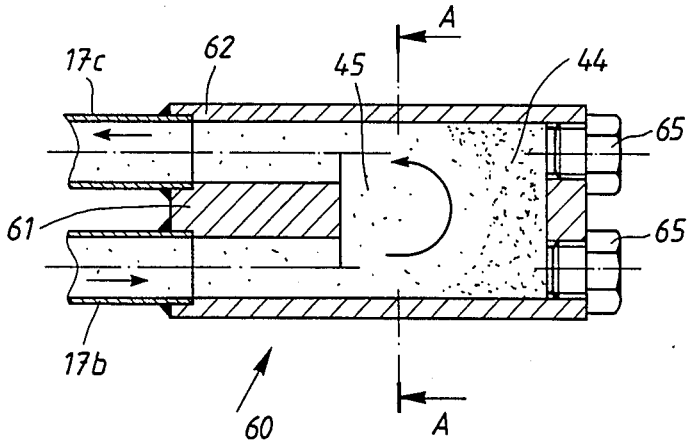
Figure 14:
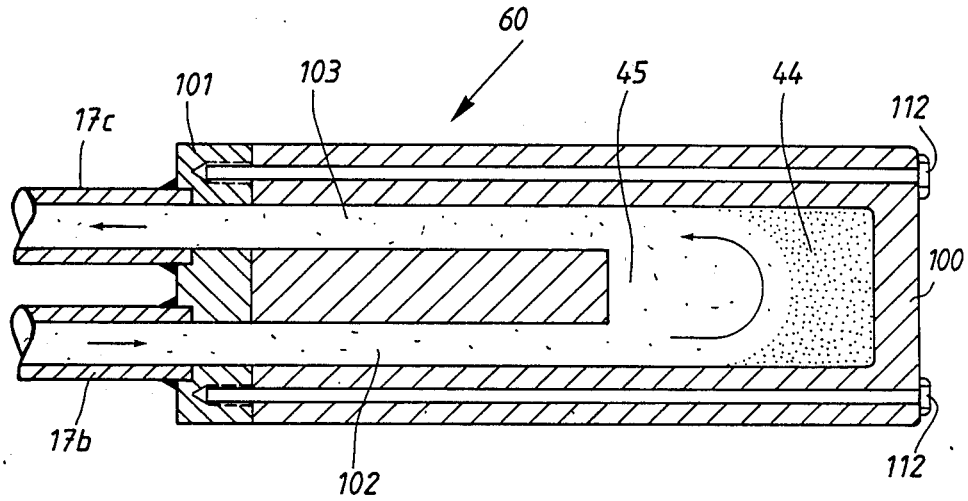
Figure 15:
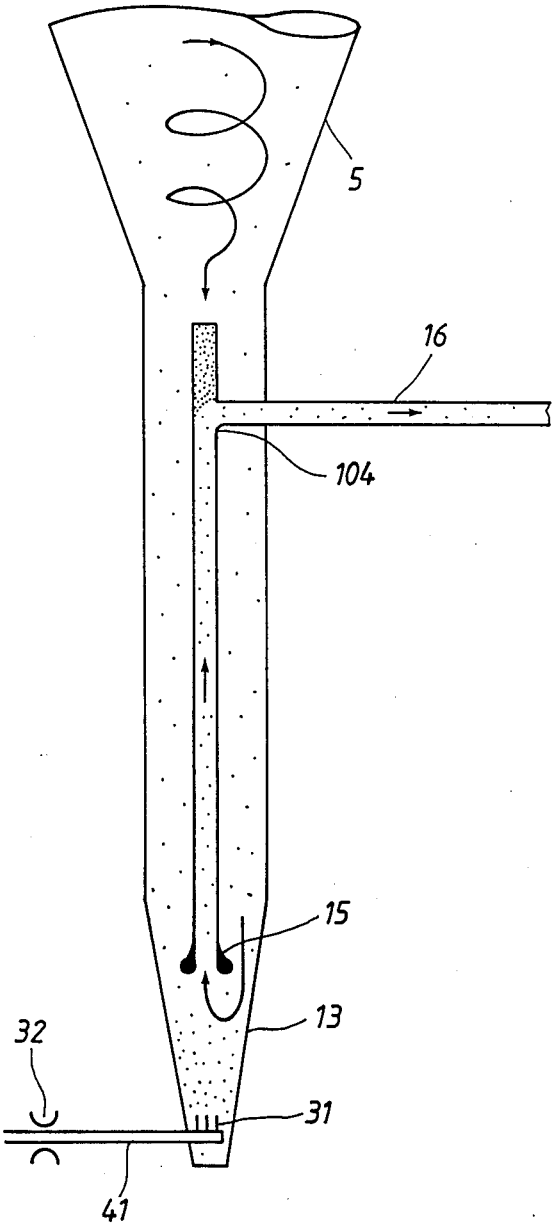
Figure 19:
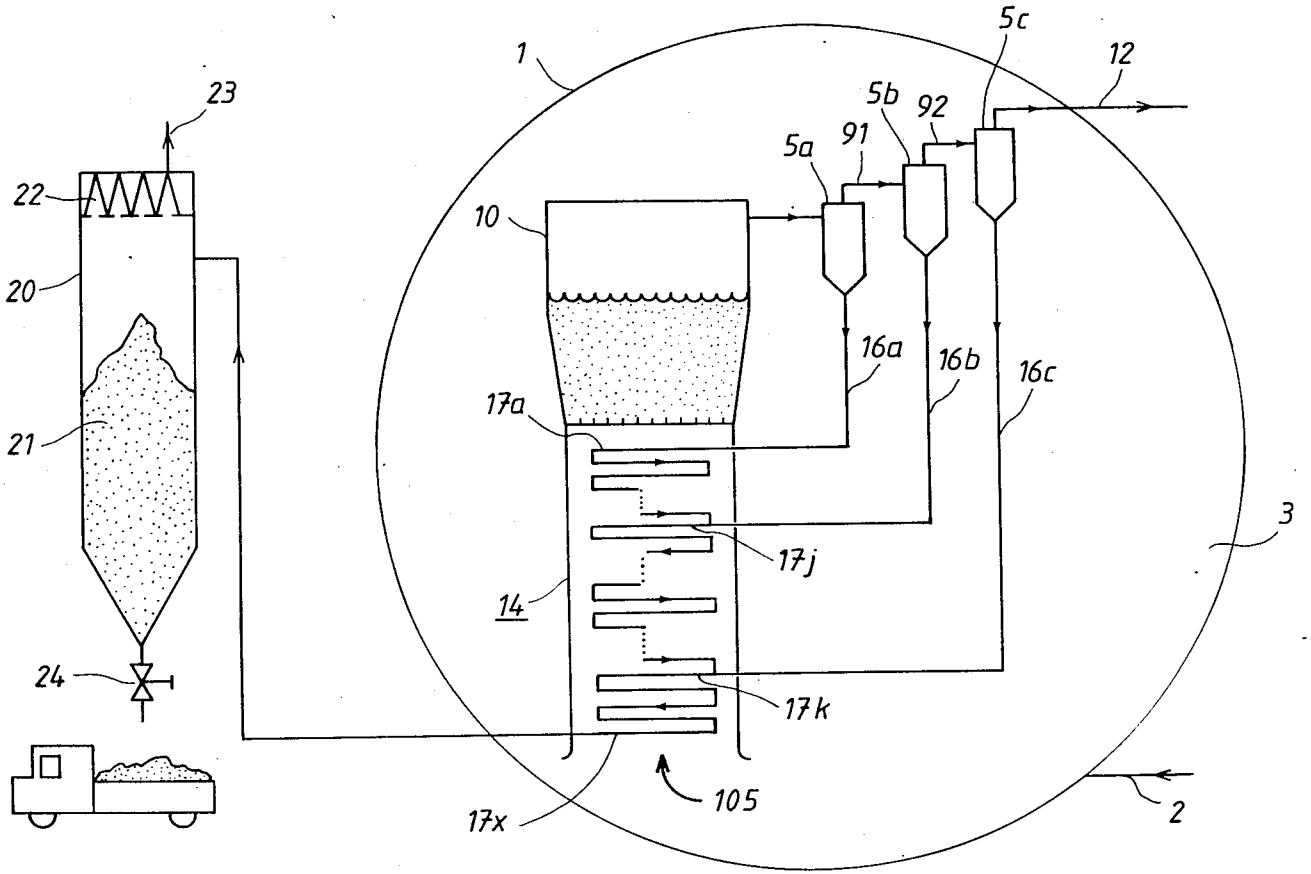

The invention will now be described, by way of example, with reference to the accompanying schematic drawings, in which:

FIG. 1 is a diagram of apparatus according to the invention for conveying ashes separated in a cyclone contained in a pressurised container, from combustion gases supplied from a fluidised bed, the separated ashes being conveyed through conduit means to a collecting container for the ashes, FIG. 2 shows an alternative embodiment in which the ash cooling is performed by water, steam or other cooling medium, FIG. 3 is a sectional view, on an enlarged scale, taken on the line A—A in FIG. 2, FIG. 4 is a sectional view showing one way of arranging tube parts of the conduit means of the apparatus of FIG. 1, FIG. 5 is a perspective view showing another way of arranging the tube parts of the conduit means of the apparatus of FIG. 1, FIG. 6 is a sectional view, on an enlarged scale, through two connected tube parts of the conduit means of FIG. 5, FIG. 7 is a sectional view showing a further way of joining together the tube parts of the conduit means of the apparatus of FIG. 1, FIG. 8 is a sectional view showing how the joined together tube parts of the conduit means of FIG. 7 can be directed in relation to each other, FIG. 9 is a perspective view showing yet another way of arranging the tube parts of the conduit means of the apparatus of FIG. 1, FIG. 9*a* is a sectional view taken on the plane A—A of FIG. 9, FIG. 10 is a sectional view, on an enlarged scale, through two connected tube parts of the conduit means of FIG. 9, FIG. 11 is a sectional view showing in more detail how the tube parts of FIG. 4 can be connected together, FIG. 12 is a series of sectional views, on a reduced scale, taken on the lines A—A to E—E of FIG. 11, FIGS. 13 and 14 are sectional views showing other ways of connecting together two tube parts of the conduit means of FIG. 9, FIG. 13A is a sectional view taken on lines A—A of FIG. 13, FIG. 15 is a sectional view of one embodiment of the ash outlet from a cyclone of the apparatus of FIG. 1 or 2, FIGS. 16, 16*a* and 17 are sectional views of modified embodiments of the ash outlet of FIG. 15, FIG. 18 is a sectional view of a modified arrangement of the conduit means of the apparatus of FIG. 1, FIG. 18*a* is a detail, on an enlarged scale of part of FIG. 18, and FIG. 19 is a sectional view of apparatus according to the invention for conveying ashes from a number of cyclones connected in series with each other within a pressurised container.

In the various figures of the drawings, the same reference numerals have been used to designate the same or similar items.

In FIG. 1, the reference numeral 1 designates a container which is under pressure. By a conduit 2 the space 3 inside the container 1 is supplied with combustion air from a compressor (not shown). The container 1 comprises a combustion chamber 4 and a cyclone 5. In reality there may be many cyclones connected in parallel and in series. In the lower part of the combustion chamber there is a fluidized bed 6 of particulate material, and a tube coil 7 for cooling the bed 6 and generating steam to a steam turbine (not shown). Fuel is fed to the bed 6 through a conduit 8 from a storage vessel (not shown). The plenum chamber 10 above the bed 6 is connected to the cyclone 5 by a conduit 11. In the cyclone 5, ashes 9 are separated from the flue gas before the cleaned gas is delivered to a gas turbine (not shown) through a conduit 12. The ashes 9 are collected in a conical bottom portion 13 of the cyclone 5 and are discharged through a feeding-out device and cooler, generally designated 14, which comprises a nozzle 15 within the cyclone 3. From the nozzle 15 a tube 16 conducts ashes and transport gas to a conduit means 17 in which the ash/gas flow is diverted a large number of times before passing through a tube 18 to a collecting container 20. The ash 21 is separated from the gas and collected at the bottom. The transport gas is finally removed and filtered by means of a filter 22 and discharged charged through a conduit 23 and the ash is removed from the container 20 via a sluice valve 24. The conduit means 17, which is in the form of a tube package, is enclosed in a container 25 through which the combustion air from the space 3 is passed acting as a cooling medium.

Both during start-up and operation, the pressure in the pressure vessel 1 is greater than in the cyclone 5. This difference in pressure can be made use of in a simple way to provide the cyclone 5 with a small amount of fluidising air, which holds separated ashes in motion so that they are not deposited and thus do not form a solid lump at the bottom of the cyclone. In the bottom, conical portion 13 of the cyclone 5, nozzles 31 are arranged which are supplied with air from the space 3 in the pressure vessel 1 via a throttle means 32 and a conduit 41. The throttle means 32 determines the gas flow. The fluidisation of the ashes in the cyclone 5 is set into operation automatically as soon as the plant is started.

In FIG. 1 the feeding-out device 14 is cooled by combustion air, but water, steam or other liquids or gases can be used as a cooling medium. Of course, a combination of cooling media can also be used.

FIG. 2 shows an alternative embodiment in which the conduit means 17 is placed inside a container 25 which is arranged outside the pressurised container 1. In FIG. 2 the container 25 has a tubular extension 26 which concentrically surrounds the tube 16. Cooling medium (for example water) is supplied to the container 25 through a conduit 27, circulates around the conduit means 17 and leaves the container 25 through the annular space 28 formed between tube 16 and the tubular extension 26 and is finally discharged through a conduit 30. The tube 16 is thus cooled, which increases its strength and its resistance to wear. Upon start-up of the combustion, it is possible to avoid condensation within the tube 16 and conduit means 17 by heating them by supplying heated heat transfer medium to the container 25. Such a heating of the tube 16 and conduit means 17 during start-up and low load operation to a temperature above the dew point of the transport gas being conveyed therethrough reduces the risk of condensation of sulphuric acid. The lead-through through the wall of the container 1, shown in FIG. 3, is favourable with regard to thermal expansion, whereby the thermal stresses are reduced.

As mentioned previously, the conduit means 17 may be designed as a compact package of tubes. For example the conduit means can be made with straight tube parts which can be connected to each other in different ways. In one embodiment, the tube parts 17*a*–17*x* are connected together in the way shown in FIG. 4 and form a package of tubes arranged, for example, in layers as shown in FIG. 9. In this manner a gas/particulate material mixture is arranged to flow backwards and forwards along the tube parts of one layer before undergoing similar backwards and forwards flow through the tube parts in the succeeding layers. By choosing a suitable number of tube parts, a desired feeding capacity for the conduit means can be achieved. Since the pressure successively falls during the passage through the conduit means 17, the cross-secional area of the conduit means should increase from the inlet towards the outlet (as shown in FIGS. 9*a* and 10) in order to obtain gas speeds which are not too high. In FIG. 9, cooling gas symbolized by the arrow 105 is supplied to the bottom 110 of the container 25 and exhausted from the top 111.

FIG. 5 shows an alternative method of arranging the connected together tube parts 17*a*–17*x*. In this method, the tube parts are arranged to convey the gas/particulate material mixture in a plurality of rectangular courses arranged one after another. Once again the cross-sectional areas of the tube parts 17*a*–17*x* can be increased from the inlet end to the outlet end of the tube package.

FIG. 6 shows more in detail how the tubes in FIG. 5 can be connected perpendicularly to each other. At least at the downstream end, the tube parts may be closed by means of cup-shaped socket 43, which enables inspection and cleaning in the event of clogging. In operation, a "cushion" 44 of ashes is formed in a blind space 45 at the downstream end of the tube part 17*a*, in which "cushion" 44 the speed of the ashes in the gas stream being conveyed is slowed down before changing direction and accompanying the gas stream to the next tube part 17*b*. The particulate ash material in the blind space 45 of the tube 17*a* assists in preventing abrasion of the tube material.

FIG. 7 shows an alternative method of arranging the connected together tube parts 17*a*, 17*b*, 17*c*, etc. These are arranged side-by-side in two rows with overflow openings 46 in the side walls. FIG. 8 shows that two consecutive tube parts 17*a*, 17*b*, can be oriented with any desired angle $\alpha$ between their center lines. In FIG. 8 the tube part 17*b* is below the tube part 17*a*.

Of course, combinations of the arrangements of tube part connections described above can also be used.

In some applications, where parallel tube parts are arranged close together so that an 180° bend of the gas/particulate material flow is obtained during passage from one tube part to the following tube part, the ends of the tube parts can be arranged as indicated in FIGS. 11 and 12. Slots are cut at the ends of two tube parts to be connected, and the tube walls are bent out and welded together to form sections at the bend as shown in FIG. 12.

When conveying abrasive material, it may be necessary to protect the tube part ends from wear. This can then be performed by using extra wear-resistive materials, for example ceramic material. The wear-resistive material may be in the form of a tubular insert (which can be replaced when worn), or may be applied by flame spraying the ends of the tube parts on their inside.

It is also possible to design the overflow openings in such a way that they can be very easily inspected and/or repaired. For example two adjacent tube parts 17*b*–17*c* in FIG. 9 can be connected together as shown in FIGS. 10 and 13 with a connecting chamber 60.

As shown in FIGS. 10 and 13 an upstream tube part 17*b* is connected to a downstream tube part 17*c* by means of the connecting chamber 60. The tube parts 17*b* and 17*c* are attached at their ends to the end wall 61 of a casing 62. At the end opposite the end wall 61, the chamber 60 is either provided with a lid 63 secured to the casing 62 by means of bolts 64, as shown in FIG. 10, or with screw plugs 65 allowing inspection and cleaning of the tubes as shown in FIG. 13. The chamber 60 forms the blind space 45 where the "cushion" 44 is built up of the ash. The material of the chamber 60 can suitably be cast iron of a wear resistance quality.

FIG. 14 shows yet another embodiment of the connecting chamber 60. This embodiment is suitable when conveying very abrasive material. In such cases it may happen that erosion occurs at the inlet of the bore 103 downstream of the blind space 45 where the flow may be turbulent. In this type of connecting chamber the casing 100 includes the blind space 45 as well as bores 102 and 103 constituting extensions to the tubes 17*b* and 17*c*. The casing 100 is connected to a flange 101 by means of bolts 112. Anticipated erosion in the casing 100 and especially in the bore 103 can be handled by selecting wear-resistive material (e.g. Ni-hard or stellite). If, however, after a long time of operation, wear should occur the casing 100 can very easily be replaced.

Tube connections with separate connection chambers 60 and suitable support means will enable movements of the tube parts in relation to each other. In that way, movements caused by thermal expansion can be controlled in a good manner.

FIG. 15 shows a detail of one embodiment of the ash discharge part of the cyclone 5 shown in FIG. 1. The fluidised material in the conical portion 13 is exhausted through the inlet nozzle 15 to the ash tube 16. A knee bend 104 with a blind space is used to deflect the ash and gas stream from vertical to horizontal direction. Fluidising air is supplied from the internal space of the pressurised container 1 (not shown) to the nozzles 31 through the conduit 41 and the throttle means 32. The nozzle 15 is designed for laminar flow to reduce erosion at the inlet.

Figure 16:
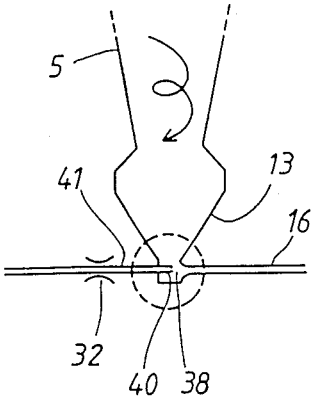
Figure 16A:
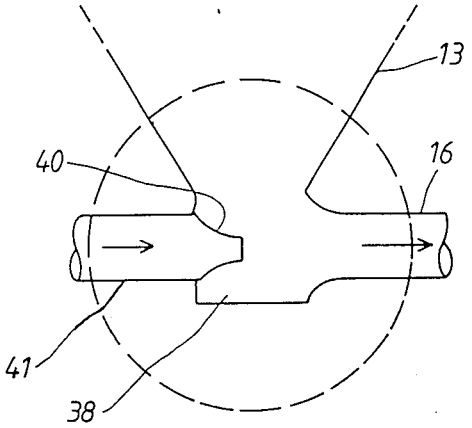

In the embodiment of the cyclone 5 shown in FIGS. 16 and 16*a*, the cyclone 5 is provided with ejector means for exhausting separated ashes. The tube 16 is connected to an ejector chamber 38 at the lower end of the conical part 13 of the cyclone. An ejector nozzle 40 opposite the tube 16 communicates with the space 3 within the container 1 through the conduit 41 having the throttle means 32 for determining the gas flow.

Figure 17:
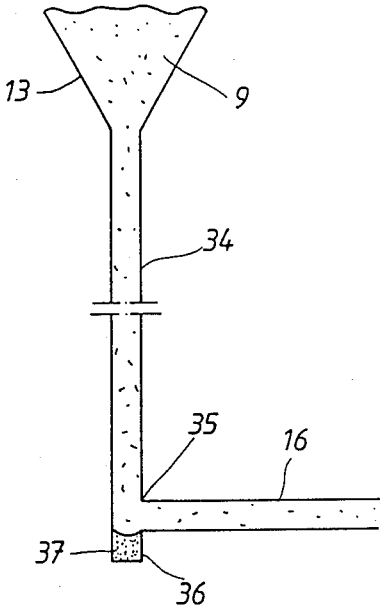

In the embodiment of the cyclone 5 shown in FIG. 17, the separated ashes 9 are discharged through a vertical tube 34 directly joined to the conical part 13 and connected to the tube 16 at an angle of approximately 90° with a knee bend 35 where the gas-ash flow is diverted 90°. At the knee bend there is a blind space 36 where a "cushion" 37 of ashes is formed. This "cushion" prevents erosion at the knee bend 35.

In the embodiment shown in FIG. 18 (in which the pressurised container is not shown), the feeding-out device 14 is provided at different points with means for supplying complementary transport gas. One or more of the tube parts 17*a*–17*x* can be connected by conduits (of which two, designated 70, 76 and 71, 77, respectively, are shown in FIG. 18) to the space inside the pressurised container. In the conduits 70 and 71, there are flow restricting throttle means 72 and 73 and valves 74 and 75. The reason for providing the means for supplying complementary transport gas is to ensure a safe transport at different loads. A PFBC combustion power plant has high investment costs and can be useful as a base power plant. Such a power plant is normally operated so as to utilise the capacity to the highest possible extent but has to be driven at low capacity when the power demand is low. An ash feed-out device 14 is therefore given dimensions for the best working conditions at full load. At low load, when the pressure in the pressurised container 1 is low, the transport speed can be too low, less than 10–15 m/s, and a risk of clogging in the tube parts in the downstream end can occur. By introducing complementary transport gas from the container 1 through the conduits 70 and 71, the desired transport speed can be achieved under all load conditions.

To minimize the air consumption through the conduits 70, 76 and 71, 77 or to obtain optimum operating conditions (transport speed) the valves 74 and 75 can be of the regulating type. In such an embodiment the throttle means 72 and 73 can be omitted. The regulating valves 74 and 75 can then be controlled by either the pressure in the pressurised container 1 or the gas velocity in any of the tube parts 17*a*–17*x*. The valves 74 and 75 can, of course, be placed inside the pressurised container 1 instead of outside. Placing them outside will of course reduce the maintenance problem. Naturally the conduits 70, 76 and 71, 77 can also be connected to another pressure source (pressurised container) with gas or air of acceptable quality, capacity and pressure.

FIG. 18*a* shows in more detail how the conduit 77 for the additional transport gas can be introduced into the connecting chamber 60.

During normal operation of a PFBC-plant shown in FIG. 1 the temperature of the solids-gas mixture leaving the cyclone 5 is 800°–850° C. and the temperature of the cooling air supplied from space 3 is 150°–300° C. The feeding out device and cooler 14 can easily be designed with such a large cooling area that the solids-gas mixture leaving the device 14 through tube 18 is only a few degrees (5°–10° C.) higher than the temperature of the incoming cooling air.

A temperature measuring device 106 (e.g. a thermocouple) at the inlet of the device 14 measuring the surface temperature of the first tube 17*a*, as shown in FIG. 18, will normally read 800°–850° C. If a blockage occurs in any of the tubes 17*a*–17*x* the measured temperature will quickly decrease to the same temperature as the cooling air. The temperature measuring device 106 can therefore be used as a cheap, simple and reliable device for detecting a blockage in the feeding out device 14.

Normally, separation of the ash from the flue gases leaving the combustion chamber 10 is carried out in cyclones connected in series by conduits 91 and 92, as shown in FIG. 19. Due to pressure losses in the cyclones 5*a*, 5*b* and 5*c* and in the conduits connecting them, the pressure is different in the different cyclones. By connecting the cyclones 5*b* and 5*c* to the tube parts 17*j* and 17*k* downstream of the inlet tube part 17*a* where the pressure in a suitable way corresponds to the pressure within the cyclones 5*b* and 5*c*, one single feeding-out device 14 can be used for all the cyclones. The connection between the tubes 16*b*–17*j* and 16*c*–17*k* can then be arranged in the same way as shown in FIG. 18*a*.

What is claimed:

1. Apparatus for providing at least part of a discharge system for conveying a mixture of gas and particulate material from a pressurized container to a collecting container or other place which is under lower pressure than the pressurized container, said apparatus comprising:

conduit means having a plurality of tube portions connected in series one after the other and including a first tube portion, a last tube portion downstream of said first tube portion, and a plurality of intermediate tube portions between said first tube portion and said last tube portion;

overflow means connecting each upstream tube portion to the successive downstream tube portion, said upstream and successive downstream tube portions opening into said overflow means, and means for discharging a continuous flow of said gas and particulate mixture from said pressurized container into said first tube portion, said overflow means connecting each tube portion to the next successive tube portion being shaped to stop the particles or substantially reduce the speed of the particles, whereafter they are accelerated again such that substantial reductions in pressure are obtained at each of said overflow means, said overflow means providing a blind space for accumulating an erosion preventing cushion taking up the impact of said particulate material at said overflow means, and the number of said tube portions and overflow means and the cross-sectional area of each being such that a desired flow of said gas and particulate material is achieved and the pressure of said flow is reduced from the pressure of said pressurized container to said lower pressure.

2. A method of discharging a mixture of gas and particulate material from a pressurized container and conveying said mixture from said pressurized container to a collecting container or other place which is under lower pressure than the pressurized container, said method comprising:

causing said gas and particulate mixture to flow through conduit means having a plurality of tube portions connected in series one after the other and including a first tube portion, a last tube portion downstream of said first tube portion, and a plurality of intermediate tube portions between said first tube portion and said last tube portion, overflow means connecting each upstream tube portion to the successive downstream tube portion, said upstream and successive downstream tube portions opening into said overflow means; and, discharging a continuous flow of said gas and particulate mixture from said pressurized container into said first tube portion, said overflow means connecting each tube portion to the next successive tube portion being shaped to stop the particles or substantially reduce the speed of the particles, whereafter they are accelerated again such that substantial reductions in pressure are obtained at each of said overflow means, said overflow means providing a blind space for accumulating an erosion preventing cushion taking up the impact of said particulate material at said overflow means, and the number of said tube portions and overflow means and the cross-sectional area of each being such that a desired flow of said gas and particulate material is achieved and the pressure of said flow is reduced from the pressure of said pressurized container to said lower pressure.

3. Apparatus according to claim 1, in which the conduit means comprises a plurality of tube portions arranged one after the other such that each of said overflow means changes the direction of said flow by an angle of at least about 90° .

4. Apparatus according to claim 1 or 3, in which pairs of tube portions are arranged one after the other, the upstream tube portion opens into the downstream tube portion via an opening which is spaced from a closed end of the upstream tube portion, the space between the said opening in, and the said closed end of, said upstream tube portion enabling the accumulation of particulate material therein during operation of the apparatus.

5. Apparatus according to claim 1 or 3, in which said conduit means comprises a plurality of substantially parallel tube parts having overflow openings adjacent closed ends thereof so that about a 180° diversion of the gas and particulate material flow is obtained during passage from one tube part to the following tube part.

6. Apparatus according to claim 5, in which said overflow openings are spaced from the ends of each tube part, the space between each overflow opening and the adjacent end of each tube part enabling the accumulation of particulate material therein during operation of the apparatus.

7. Apparatus according to claim 1 or 3, in which said conduit means comprises a plurality of tube parts and arranged in substantially parallel relation, connected in series by means of separate overflow chambers connecting an upstream tube part to the following downstream tube part (17*b*) and forming a blind space for a cushion of particulate material and diverting the gas and particulate flow through about 180° .

8. Apparatus according to claim 7, in which said chambers comprise a flange to which two adjacent tube parts are connected and a casing containing a blind space for a cushion of material as well as bores constituting an extension of said connected tube parts and, in which said casing can be dismounted from said flange.

9. Apparatus according to claim 1 or 3 in which the said conduit means comprises a plurality of tube portions connected in series one after the other and having means for supplying complementary transport gas to a tube portion between the first and the last tube portions.

10. Apparatus according to claim 9, in which the supply of complementary transport gas is controlled by the pressure in the pressurized container or by the transport gas velocity in any of the tube portions.

11. Apparatus according to claim 1 or 3 in which said conduit means comprises a number of tube portions connected in series one after the other and having means for connecting the first tube portion to a first vessel containing particulate material and for connecting another of the following tube portions to a second vessel containing particulate material.

12. Apparatus according to claim 1 or 3 which further includes means for cooling the conduit means.

13. Apparatus according to claim 12, in which said cooling means uses combustion air to a pressurized fluidized bed as the cooling medium.

14. Apparatus according to claim 13, in which the apparatus is placed inside a pressurized container surrounding a pressurized fluidized bed.

15. Apparatus according to claim 12, in which the cooling means comprises a container enclosing the conduit means and containing a coolant for surrounding the conduit means.

16. An apparatus according to claim 1 in which the direction of said flow is changed by at least 360° during conveyance of said flow from said first tube to said last tube.

17. An apparatus according to claim 1 in which the cross-sectional areas of the tube portions downstream of said first tube portion are varied from the cross-sectional area of said first tube portion.

* * * * *